US009724551B2

(12) United States Patent
Foster

(10) Patent No.: US 9,724,551 B2
(45) **Date of Patent: *Aug. 8, 2017**

(54) STRETCHING DEVICE

(71) Applicant: Thomas C. Foster, Frederick, MD (US)

(72) Inventor: Thomas C. Foster, Frederick, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/461,254

(22) Filed: Mar. 16, 2017

(65) Prior Publication Data

US 2017/0182344 A1 Jun. 29, 2017

Related U.S. Application Data

(63) Continuation of application No. 15/157,840, filed on May 18, 2016.

(Continued)

(51) Int. Cl.
*A63B 21/002* (2006.01)
*A63B 21/00* (2006.01)

(Continued)

(52) U.S. Cl.
CPC ..... *A63B 21/0023* (2013.01); *A61H 1/02* (2013.01); *A61H 1/0237* (2013.01); *A61H 1/0274* (2013.01); *A63B 21/00181* (2013.01); *A63B 21/1627* (2013.01); *A63B 21/1645* (2013.01); *A63B 21/4035* (2015.10);

(Continued)

(58) Field of Classification Search
CPC ..... A63B 21/00; A63B 21/0023; A63B 21/00178; A63B 21/00181; A63B 21/154; A63B 21/1627; A63B 21/1645; A61H 1/00; A61H 1/02; A61H 1/0218; A61H 1/0229; A61H 1/0237; A61H 1/024; A61H 1/0244; A61H 1/0255; A61H 1/0259; A61H 1/0262; A61H 1/0266; A61H 1/0274; A61H 1/0277; A61H 1/0281; A61H 1/0285; A61H 1/0288; A61H 1/0292; A61H 1/0296

See application file for complete search history.

(56) References Cited

U.S. PATENT DOCUMENTS 2,134,451 A * 10/1938 Mogren ..... A63B 21/06 473/457
2,716,027 A * 8/1955 Gehri ..... A63B 21/023 482/131

(Continued)

*Primary Examiner* — Joshua Lee

(57) ABSTRACT

A stretching device that enables a user to employ the mechanical advantage of a multi-pulley system while performing various, prolonged muscle stretches; the stretching device including a first anchor assembly, a second anchor assembly, and a motion transfer line. The first motion transfer line has a first anchor body and a first motion transfer pulley; the first anchor body being attached to the user and the first motion transfer pulley being coupled to the first anchor body. Similarly, the second motion transfer line has a second anchor body and a second motion transfer pulley; the second anchor body being attached to a stationary object and the second motion transfer pulley being coupled to the second anchor body. The motion transfer line is terminally attached to the first anchor body and is trained around both the first motion transfer pulley and the second motion transfer pulley.

13 Claims, 9 Drawing Sheets

Related U.S. Application Data

(60) Provisional application No. 62/163,003, filed on May 18, 2015.

(51) Int. Cl.
*A63B 21/16* (2006.01)
*A61H 1/02* (2006.01)

(52) U.S. Cl.
CPC ..... *A61H 2201/0119* (2013.01); *A61H 2201/1269* (2013.01); *A61H 2201/1463* (2013.01); *A61H 2201/1638* (2013.01); *A61H 2201/1642* (2013.01); *A61H 2201/1666* (2013.01)

(56) References Cited

U.S. PATENT DOCUMENTS 3,999,752 A * 12/1976 Kupperman ..... A63B 21/154 273/DIG. 19
5,067,709 A * 11/1991 Christianson ..... A63B 23/0482 254/398
5,253,639 A * 10/1993 Johnston ..... A63B 23/03575 482/131
5,423,730 A * 6/1995 Hirsch ..... A63B 21/06 482/92
6,322,483 B1 * 11/2001 Rotella ..... A63B 21/0552 482/129
6,422,981 B1 * 7/2002 Riser ..... A63B 21/154 482/142
6,908,418 B2 * 6/2005 Saure ..... A63B 21/0552 482/121
7,364,555 B1 * 4/2008 Davidson ..... A61H 1/0274 601/33
8,376,919 B2 * 2/2013 Eddy ..... A63B 21/00 482/131
8,556,755 B1 * 10/2013 Zackery ..... A63B 21/00185 473/453
2002/0022555 A1 * 2/2002 Nesci ..... A63B 21/002 482/91
2011/0034307 A1 * 2/2011 Eddy ..... A63B 21/00 482/131
2014/0315695 A1 * 10/2014 Scott ..... A61H 1/02 482/91

* cited by examiner

STRETCHING DEVICE

The current application is a continuation of U.S. Utility patent application Ser. No. 15/157,840 filed on May 18, 2016 which claims a priority to the U.S. Provisional Patent application Ser. No. 62/163,003 filed on May 18, 2015.

FIELD OF THE INVENTION

The present invention relates generally to therapeutic stretching. More specifically, the present invention is a stretching device that can be anchored to a variety of objects for performing controlled stretches while providing a mechanical advantage.

BACKGROUND OF THE INVENTION

The practice of stretching one's body has many benefits for both athletic and therapeutic applications, such as loosening up limbs to prevent injury. Additionally, stretching can play an integral role in the rehabilitation of a body part after an injury. In both cases there are benefits that are derived from performing controlled stretches that force an individual to hold a stretch for longer periods of time. Furthermore, the effectiveness of stretching is increased as an individual is compelled to stretch a limb beyond what is naturally considered comfortable. However, it is often difficult for an individual to perform extended controlled stretches, especially when attempting to stretch near or above the individual's comfort threshold. This is typically due to the fatigue of maintaining a limb in the desired position for an extended period of time, or the inability of the individual to exert enough force in order to reach their comfort threshold.

Therefore it is the object of the present invention to provide a stretching device that uses a fixed anchor point, pulleys, a harness, and a motion transfer line to maximize the benefits that a user is able to achieve from a controlled stretch. A first anchor assembly includes a first anchor body and a first motion transfer pulley, while a second anchor assembly includes a second anchor body and a second motion transfer pulley; the first motion transfer pulley being attached to the first anchor body and the second motion transfer pulley being attached to the second anchor body. The first anchor body serves as the harness that is attached to the limb of the user, while the second anchor body serves as the fixed anchor point that is attached to a stationary object. The motion transfer line is terminally attached to the first anchor body and is trained around both the first motion transfer pulley and the second motion transfer pulley. By pulling the free end of the motion transfer line, the user can employ the mechanical advantages of the present invention to perform extended, controlled stretches.

DETAIL DESCRIPTIONS OF THE INVENTION

All illustrations of the drawings are for the purpose of describing selected versions of the present invention and are not intended to limit the scope of the present invention.

The present invention is a stretching device that enables a user to employ the mechanical advantage of a multi-pulley system while performing various, prolonged muscle stretches. In addition to being used to stretch limbs the present invention can be repurposed as a lifting apparatus. Elderly patients and convalescents are able to anchor the adjustable anchor to an elevated anchor point and make use of the mechanical advantages afforded by the pulley system to lift and reposition limbs, or even entire bodies.

In order to provide the mechanical advantages, the present invention comprises a first anchor assembly 1, a second anchor assembly 2, and a motion transfer line 3. In reference to FIG. 1, the motion transfer line 3 is trained around the first anchor assembly 1 and the second anchor assembly 2, wherein a free end of the motion transfer line 3 can be pulled by the user in order to manipulate a limb of the user in the desired stretching position. The first anchor assembly 1 is attached to the limb of the user, while the second anchor assembly 2 is attached to a stationary object such as a post, fence, door, other limb, etc. It is an aim of the present invention to provide an apparatus that can be anchored to objects of varying shape and size using the second anchor assembly 2.

Figure 1:
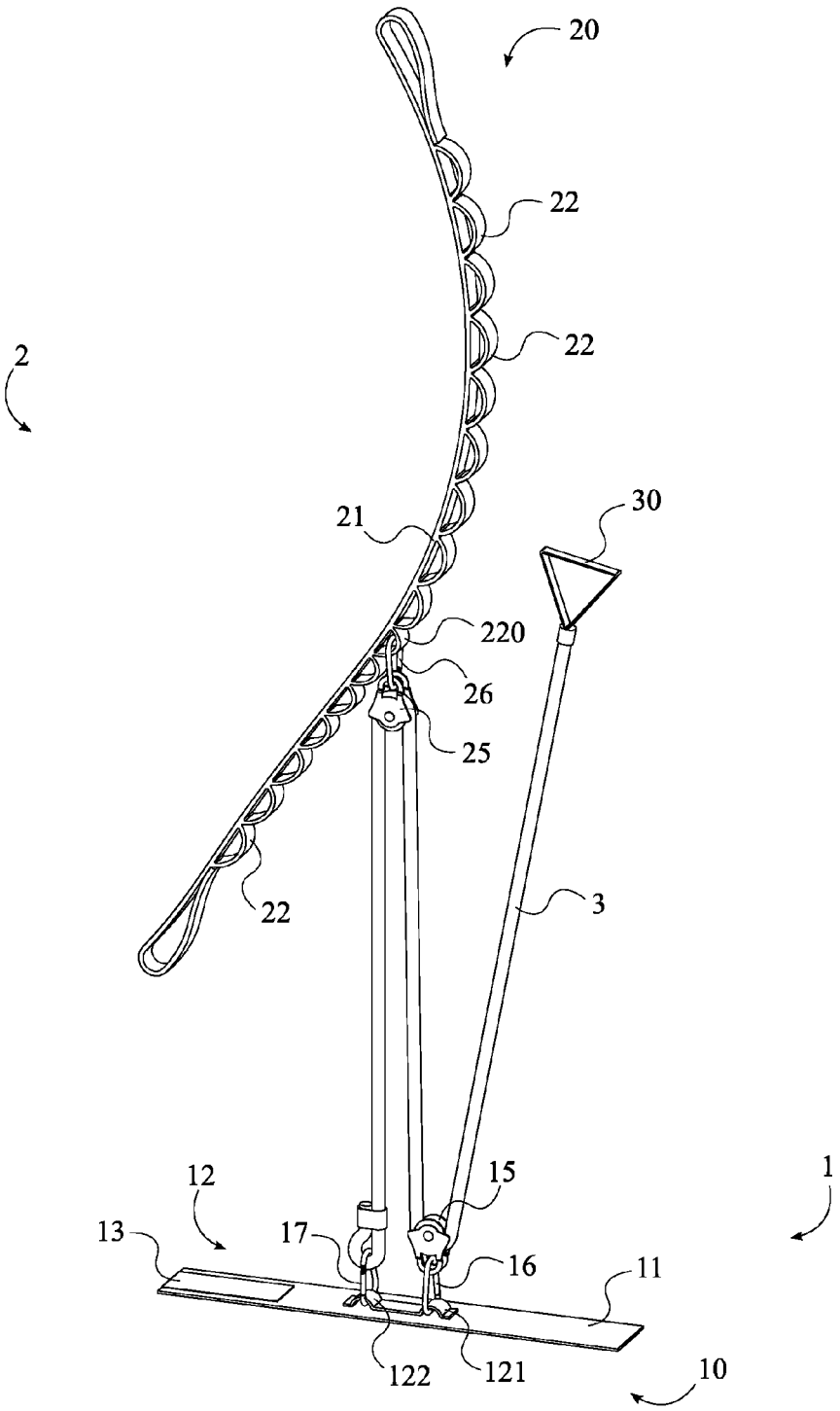
FIG. 1 is a perspective view of the present invention in the preferred embodiment, wherein the first strap is open, depicting the first body fastener.

The first anchor assembly 1, or limb harness, is attached to the limb of the user and comprises a first anchor body 10, a first motion transfer pulley 15, a first detachable pulley-fastener 16, and a detachable motion-line fastener 17, as depicted in FIG. 1. The first anchor body 10 is the portion of the first anchor assembly 1 that is attached to the limb of the user. Both the first motion transfer pulley 15 and the motion transfer line 3 are pivotally coupled to the first anchor body 10, wherein the first motion transfer pulley 15 and the motion transfer line 3 are positioned about the first anchor body 10 opposite the limb of the user. In reference to FIG. 1, the first anchor body 10 comprises a first strap 11 and a first plurality of anchor points 12; the first plurality of anchor points 12 being positioned along the first strap 11. The first motion transfer pulley 15 is pivotally coupled to a first anchor point 121 from the first plurality of anchor points 12, while the motion transfer line 3 is terminally coupled to a second anchor point 122 from the first plurality of anchor points 12.

The first strap 11 is a flexible piece of material that is size adjustable, such that the first anchor body 10 can be fitted around various positions along the extremities of the user (e.g. wrist, ankle, thigh, calf). The first plurality of anchor points 12 is integrated into the first strap 11, providing a means for coupling the first motion transfer pulley 15 and the motion transfer line 3 to the first strap 11. In the preferred embodiment of the present invention, each of the first plurality of anchor points 12 is formed by a length of material that forms a loop in conjunction with the first strap 11. In another embodiment of the present invention, each of the first plurality of anchor points 12 is formed by a hole that traverses through the first strap 11. In yet other embodiments of the present invention, the first plurality of anchor points 12 may be designed using hooks, snaps, latches, clips, or any other fastening means.

In reference to FIG. 1, the first motion transfer pulley 15 is pivotally coupled to the first anchor point 121 by the first detachable pulley-fastener 16, wherein the first detachable pulley-fastener 16 is connected in between the first motion transfer pulley 15 and the first anchor point 121. Similarly, the motion transfer line 3 is terminally coupled to the second anchor point 122 by the detachable motion-line fastener 17, wherein the detachable motion-line fastener 17 is connected in between the motion transfer line 3 and the second anchor point 122. In the preferred embodiment of the present invention, both the first detachable pulley-fastener 16 and the detachable motion-line fastener 17 are carabiners, wherein the first motion transfer pulley 15 and the motion transfer line 3, respectively, can be quickly disengaged from the first strap 11. In other embodiments of the present invention, other removable fastener types may be used for the first detachable pulley-fastener 16 and the detachable motion-line fastener 17.

The first anchor body 10 further comprises a first body fastener 13 and a second body fastener 14 that are used to secure the first strap 11 around the limb of the user. In reference to FIG. 1-2, the first body fastener 13 and the second body fastener 14 are adjacently connected to the first strap 11, wherein the first body fastener 13 and the second body fastener 14 are terminally positioned opposite each other along the first strap 11. When the first body fastener 13 is engaged with the second body fastener 14, the first strap 11 is formed into a loop to fit around the limb of the user, as depicted in FIG. 3. In the preferred embodiment of the present invention, the first body fastener 13 and the second body fastener 14 are opposing hook and loop fasteners, wherein the first body fastener 13 and the second body fastener 14 are positioned on opposite sides of the first strap 11. Other embodiments of the present invention may utilize other fastening means for the first body fastener 13 and the second body fastener 14 including, but not limited to, a buckle, snaps, or buttons. The first plurality of anchor points 12 is positioned in between the first body fastener 13 and the second body fastener 14, such that when tension is applied to the first strap 11 through the first motion transfer pulley 15 and the motion transfer line 3, the first strap 11 is not pulled open.

The second anchor assembly 2, or adjustable anchor, is attached to a stationary object and comprises a second anchor body 20, a second motion transfer pulley 25, and a second detachable pulley-fastener 26, as depicted in FIG. 1. The second anchor body 20 is the portion of the second anchor assembly 2 that is attached to the stationary object. The second motion transfer pulley 25 is pivotally coupled to the second anchor body 20, wherein the second motion transfer pulley 25 is positioned about the second anchor body 20 opposite the stationary object. More specifically, the second motion transfer pulley 25 is pivotally coupled to the second anchor body 20 by the second detachable pulley-fastener 26, wherein the second detachable pulley-fastener 26 is connected in between the second motion transfer pulley 25 and the second anchor body 20, as depicted in FIG. 1. The second anchor body 20 can be designed in a number of different ways depending on the intended stationary object. The second anchor body 20 may be configured to be compatible with a number of different object, or the second anchor body 20 may be tailored for attachment to a specific object, such as a door.

Figure 2:
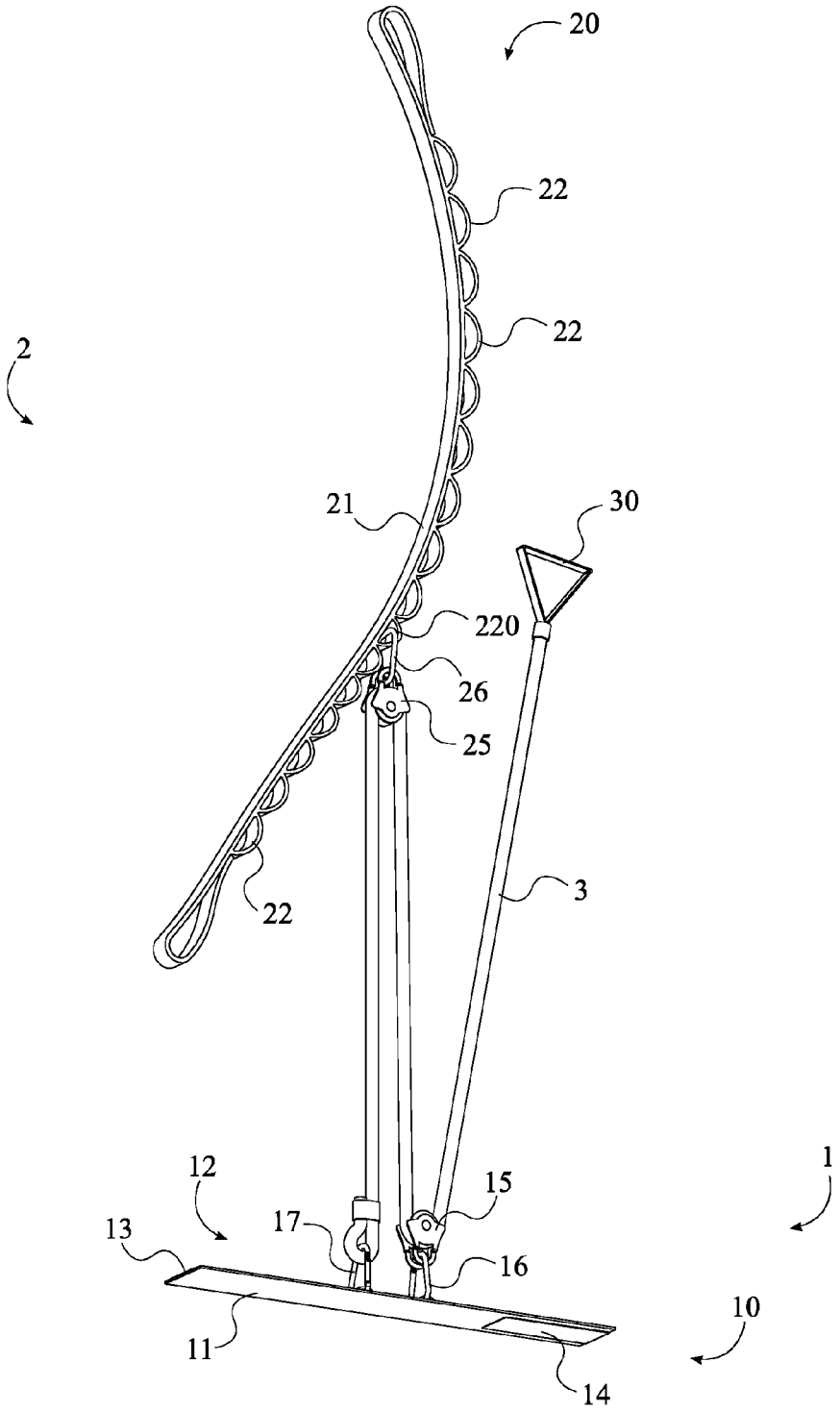
FIG. 2 is a perspective view of the present invention in the preferred embodiment, wherein the first strap is open, depicting the second body fastener.
Figure 3:
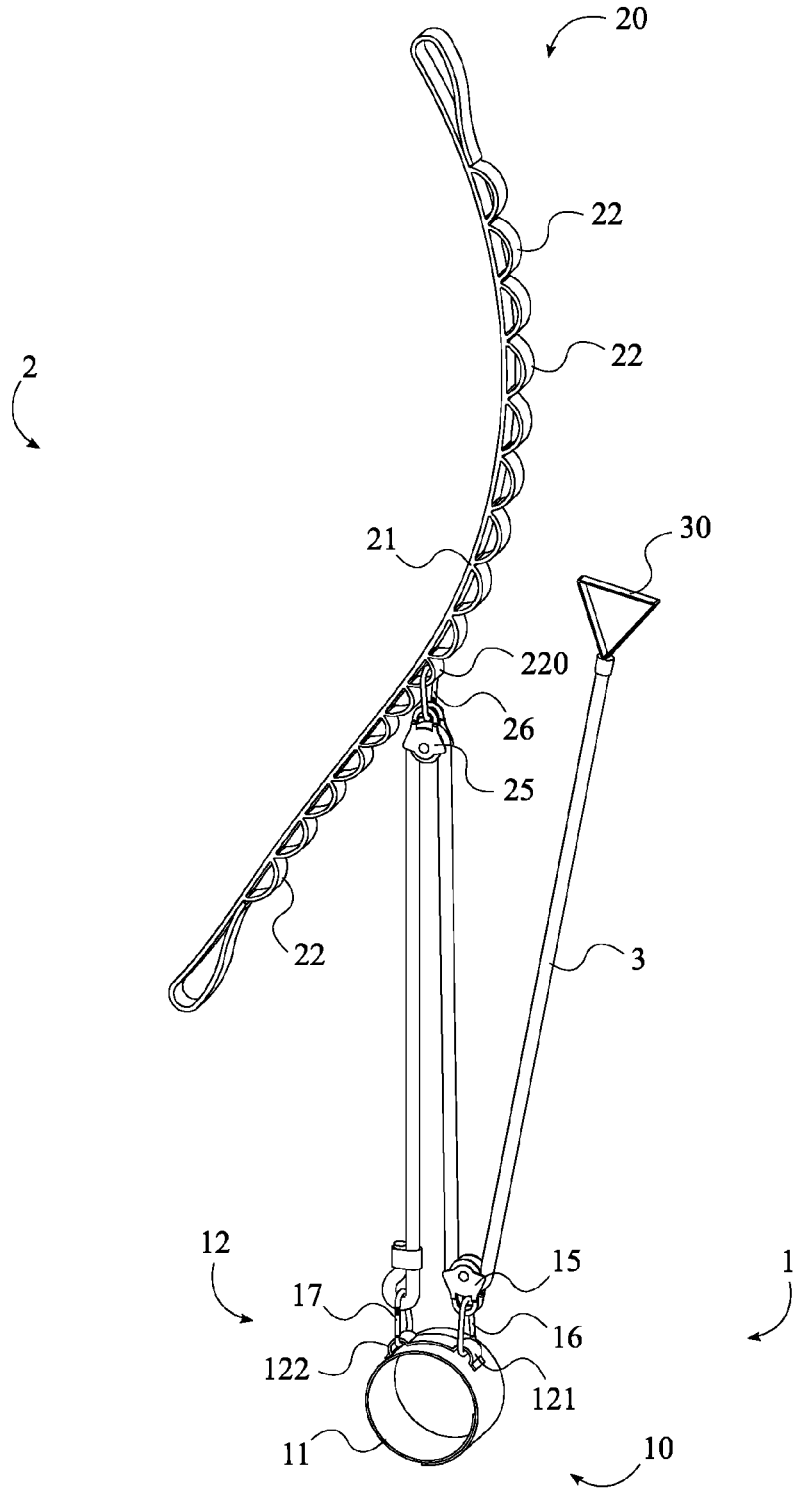
FIG. 3 is a perspective view of the present invention embodiment, wherein the first strap is closed; the first body fastener engaging the second body fastener such that the first strap forms a loop.

In the preferred embodiment of the present invention, as depicted in FIG. 1-3, the second anchor body 20 comprises a second strap 21 and a second plurality of anchor points 22; the plurality of anchor points being positioned along the second strap 21. The second strap 21 is a flexible piece of material that can be wrapped around or otherwise attached to various objects in order to anchor the present invention in place. The second plurality of anchor points 22 is integrated into the second strap 21, providing a means for coupling the second motion transfer pulley 25 to the second strap 21. In the preferred embodiment of the present invention, each of the second plurality of anchor points 22 is formed by a length of material that forms a loop in conjunction with the second strap 21. In another embodiment of the present invention, each of the second plurality of anchor points 22 is formed by a hole that traverses through the second strap 21. In yet other embodiments of the present invention, the second plurality of anchor points 22 may be designed using hooks, snaps, latches, clips, or any other fastening means.

In order to fasten the second anchor body 20 in place, the second strap 21 is wrapped around the stationary object. The second strap 21 can be secured in place by tying a single end of the second strap 21 around the stationary object, tying together the ends of the second strap 21, or by using a fastener, such as a carabiner, to secure two anchor points from the second plurality of anchor points 22 together. Alternatively, each end of the second strap 21 can be tied separately to the same object or to different objects. The second motion transfer pulley 25 is pivotally coupled to an arbitrary anchor point 220 from the second plurality of anchor points 22 and is directed away from the stationary object. The arbitrary anchor point 220 is determined according to the stationary object to which the second anchor body 20 is being attached and the desired stretching exercise that is to be performed.

More specifically, the second motion transfer pulley 25 is pivotally coupled to the arbitrary anchor point 220 by the second detachable pulley-fastener 26, wherein the second detachable pulley-fastener 26 is connected in between the second motion transfer pulley 25 and the arbitrary anchor point 220, as depicted in FIG. 1. In the preferred embodiment of the present invention, the second detachable pulley-fastener 26 is a carabiner, wherein the second motion transfer pulley 25 can be quickly disengaged from the second strap 21. In other embodiments of the present invention, other removable fastener types may be used for the second detachable pulley-fastener 26.

Figure 4:
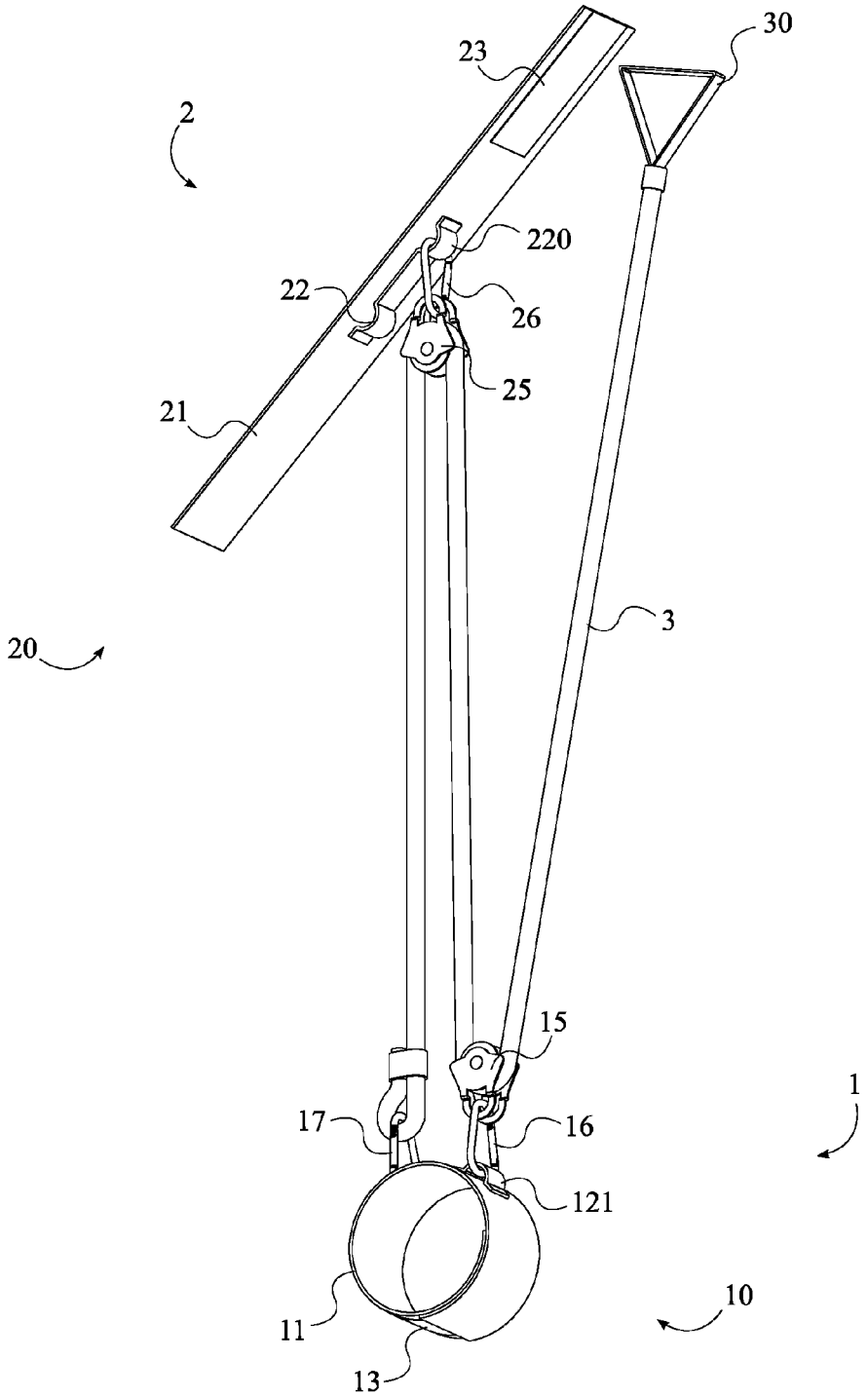
FIG. 4 is a perspective view of the present invention in an alternative embodiment, wherein the second strap is open, depicting the first strap fastener.
Figure 5:
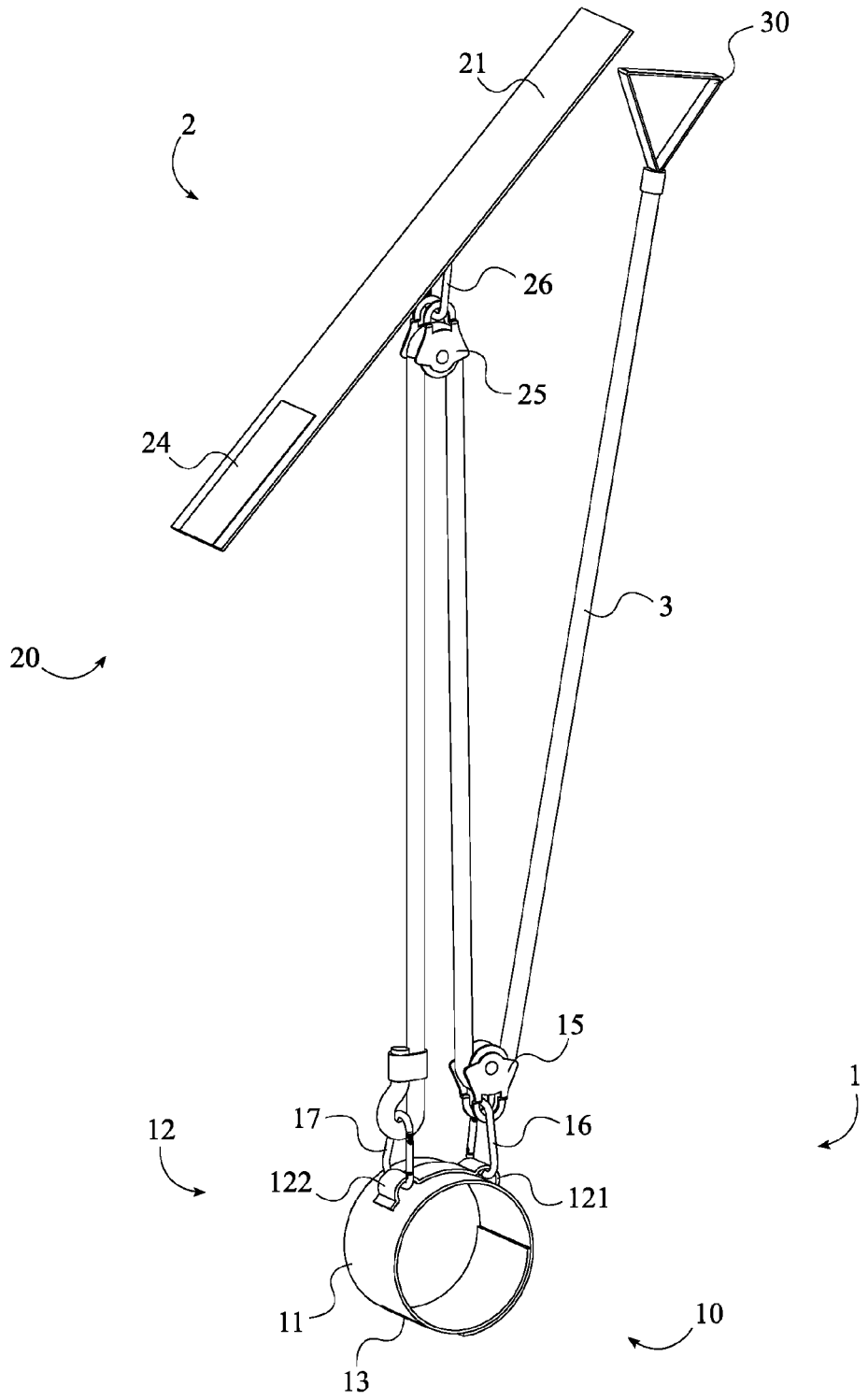
FIG. 5 is a perspective view of the present invention in an alternative embodiment, wherein the second strap is open, depicting the second strap fastener.
Figure 6:
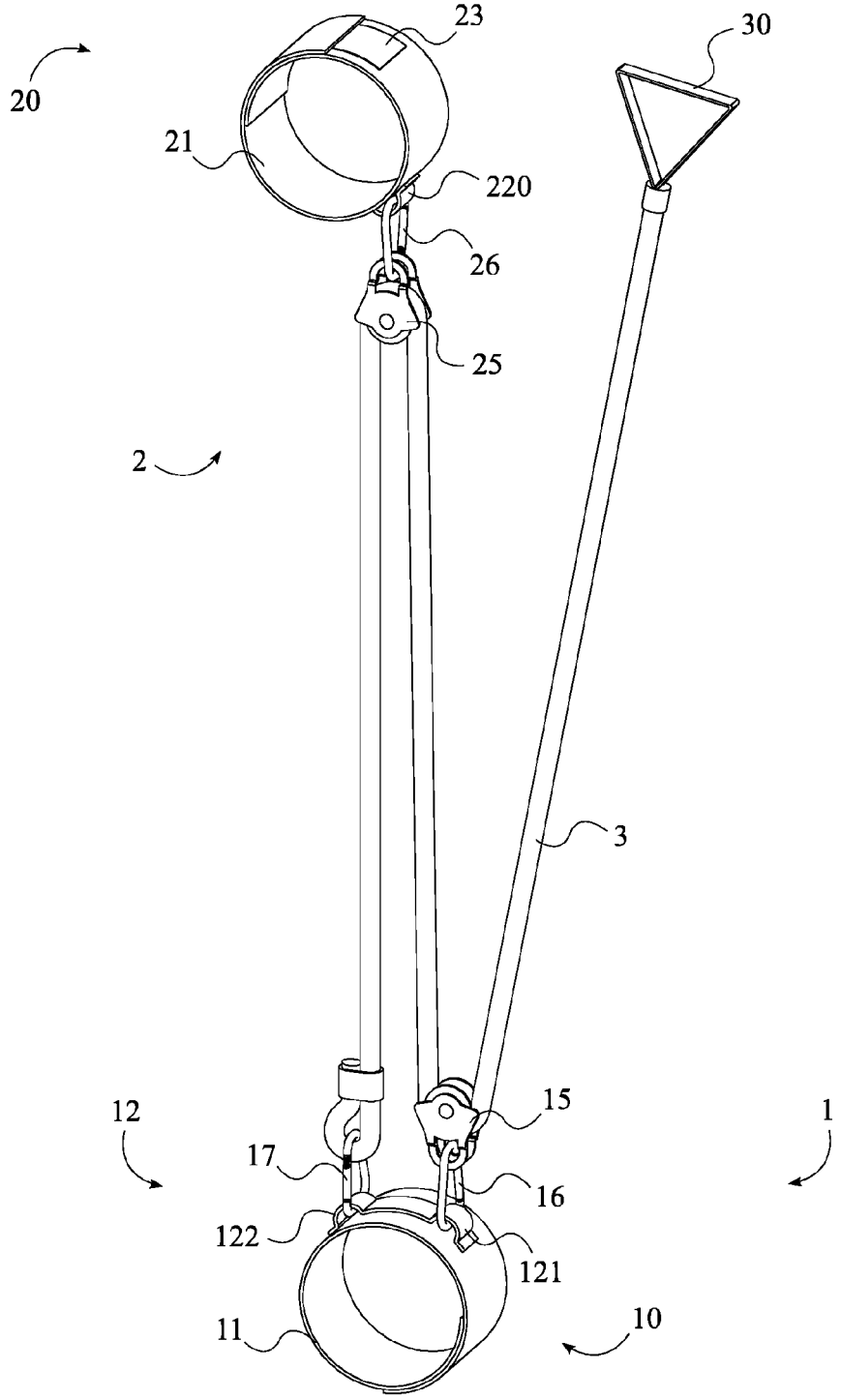
FIG. 6 is a perspective view of the present invention in an alternative embodiment, wherein the second strap is closed; the first strap fastener engaging the second strap fastener such that the second strap is formed into a loop.

In another embodiment of the present invention, as depicted in FIG. 4-6, the second anchor body 20 is designed similar to the first anchor body 10, wherein the second anchor body 20 further comprises a first strap fastener 23 and a second strap fastener 24 that are used to secure the second strap 21 around the stationary object. In reference to FIG. 4-5, the first strap fastener 23 and the second strap fastener 24 are adjacently connected to the second strap 21, wherein the first strap fastener 23 and the second strap fastener 24 are terminally positioned opposite each other along the second strap 21. When the first strap fastener 23 is engaged with the second strap fastener 24, the second strap 21 is formed into a loop to fit around the stationary object, as depicted in FIG. 6. Preferably, the first strap fastener 23 and the second strap fastener 24 are opposing hook and loop fasteners, wherein the first strap fastener 23 and the second strap fastener 24 are positioned on opposite sides of the second strap 21. Other embodiments of the present invention may utilize other fastening means for the first strap fastener 23 and the second strap fastener 24 including, but not limited to, a buckle, snaps, or buttons. The second plurality of anchor points 22 is positioned in between the first strap fastener 23 and the second strap fastener 24, such that when tension is applied to the second strap 21 through the second motion transfer pulley 25, the second strap 21 is not pulled open.

Figure 7:
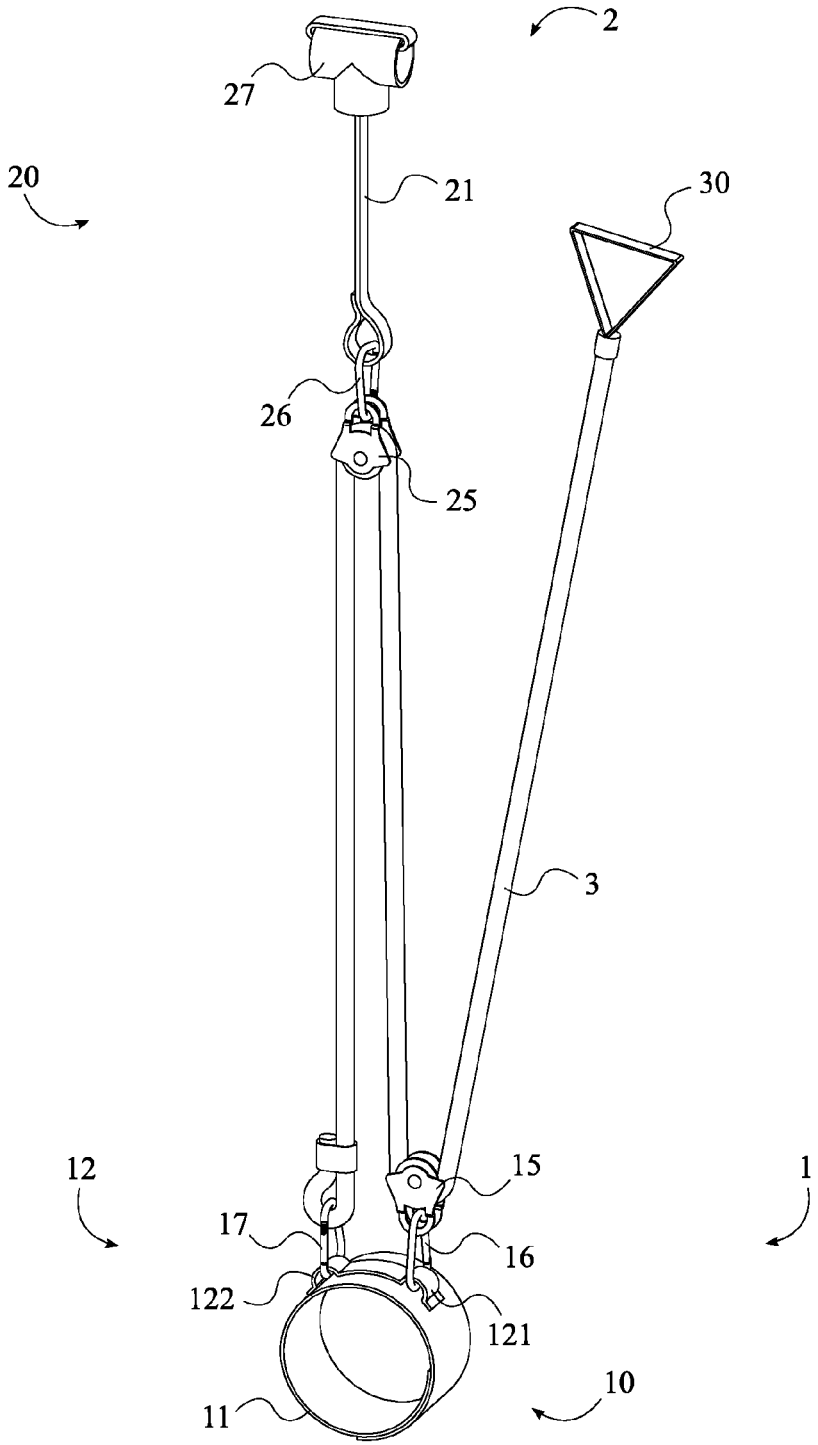
FIG. 7 is a perspective view of the present invention, wherein the second anchor body is configured with a door anchor.

In yet another embodiment of the present invention, as depicted in FIG. 7, the second anchor body 20 is designed to attach to a door, wherein the second anchor body 20 comprises the second strap 21 and a door anchor 27. The second strap 21 is pivotally coupled to the second motion transfer pulley 25 by the second detachable pulley-fastener 26; the second detachable pulley-fastener 26 being connected in between the second strap 21 and the second motion transfer pulley 25. In reference to FIG. 7, the door anchor 27 is terminally connected to the second strap 21 opposite the second motion transfer pulley 25 and provides the means for securing the second anchor body 20 to the door. The door anchor 27 is a sizeable object that cannot fit between the door and the door frame. When in use, the door anchor 27 is positioned on the side of the door opposite the user, wherein the second strap 21 traverses between the door and the door frame. In this way, the door anchor 27 cannot be pulled through and the user is able to perform the desired stretches. In some embodiments of the present invention, the door anchor 27 can alternatively be a hook that is positioned around the top or side of the door.

With the first anchor assembly 1 and the second anchor assembly 2 secured in place, the motion transfer line 3 is utilized to manipulate the limb of the user in order to perform the desired stretch. The motion transfer line 3 is a flexible, but inelastic, length of cord that transfers force applied to a terminal end of the motion transfer line 3 to the limb of the user. In reference to FIG. 1, the motion transfer line 3 is terminally connected to the first anchor body 10, and is trained around both the first motion transfer pulley 15 and the second motion transfer pulley 25. More specifically, the motion transfer line 3 is terminally connected to the first anchor body 10 by the detachable motion-line fastener 17, wherein the motion transfer line 3 extends away from the first anchor body 10. The motion transfer line 3 is then trained around the second motion transfer pulley 25 which is connected to the stationary object via the second anchor body 20. Finally, the motion transfer line 3 is trained around the first motion transfer pulley 15 which is connected to the limb of the user via the first anchor body 10.

In reference to FIG. 1, the motion transfer line 3 comprises a hand connection 30, wherein the hand connection 30 is terminally positioned opposite the first anchor body 10. Resultantly, the hand connection 30 is positioned at the free end of the motion transfer line 3, providing the user with a means for grasping and pulling the motion transfer line 3. In the preferred embodiment of the present invention, the hand connection 30 is simply a knot tied in the end of the motion transfer line 3. However, in other embodiments of the present invention, the hand connection 30 may be a single handle or double handle affixed to the cord. By grasping the hand connection 30 and pulling on the motion transfer line 3, the user is able to utilize the mechanical advantage provided by the first motion transfer pulley 15 and the second motion transfer pulley 25 to perform the desired stretching exercise, or lift and reposition the desired appendage.

Figure 8:
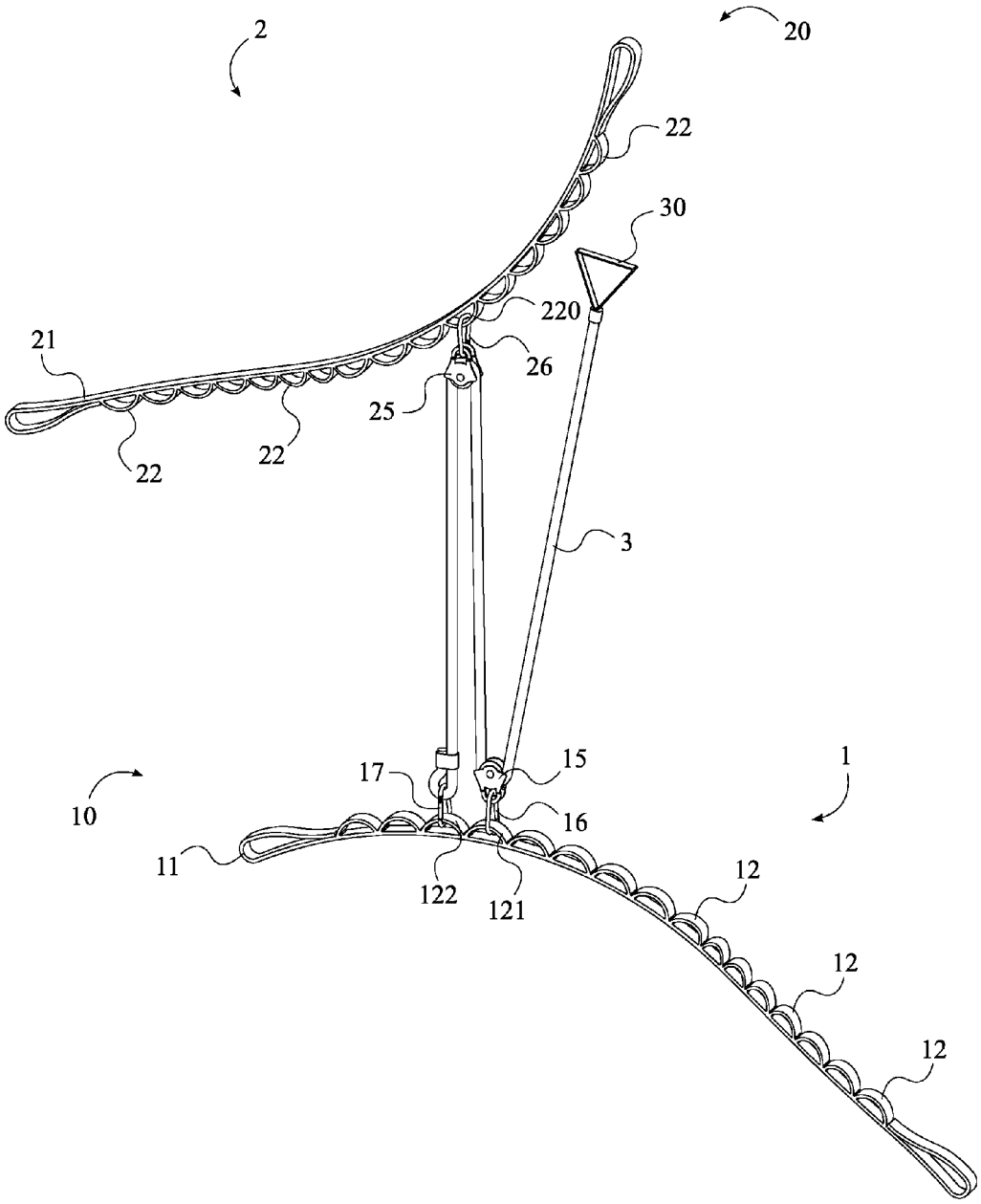
FIG. 8 is a perspective view of the present invention, wherein the first anchor body is configured without the first body fastener and the second body fastener, and the second anchor body is configured without the first strap fastener and the second strap fastener.
Figure 9:
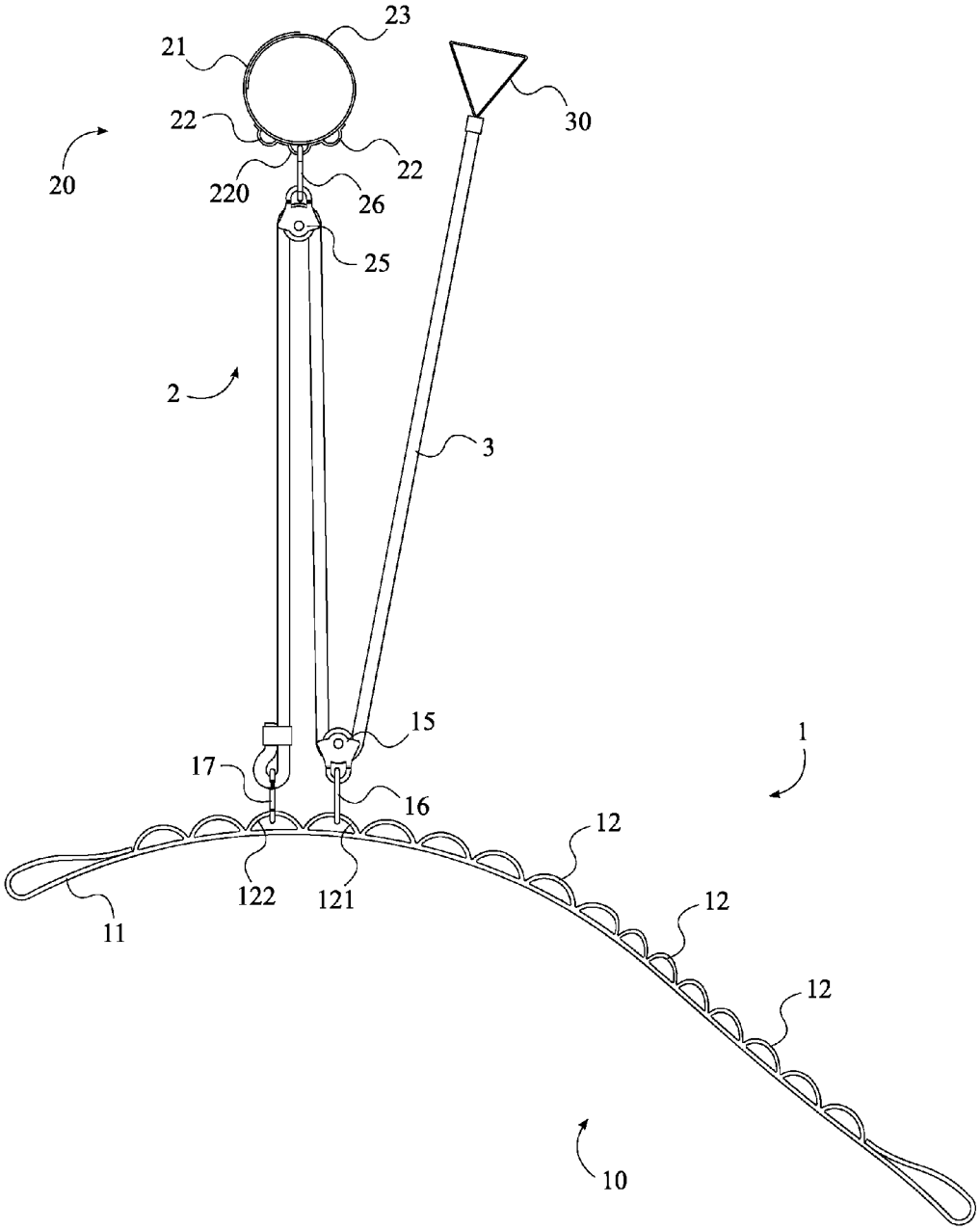
FIG. 9 is a front elevational view of the present invention, wherein the first anchor body is configured without the first body fastener and the second body fastener, while the second anchor body is configured with the first strap fastener and the second strap fastener.

The removable nature of the first motion transfer pulley 15 and the motion transfer line 3 from the first anchor body 10, and the removable nature of the second motion transfer pulley 25 from the second anchor body 20 allows for versatile reconfigurations that can be used for a number of stretches. In addition to providing the ability to swap the position of the first anchor body 10 and the second anchor body 20, the removable nature allows for different anchor types to be interchanged depending on the desired stretch. FIG. 8-9 show the first anchor body 10 being alternatively configured, wherein the first anchor body 10 does not include the first body fastener 13 and the second body fastener 14; meanwhile, the second anchor body 20 includes the first strap fastener 23 and the second strap fastener 24. Additionally, the removable nature enhances the portability and storage of the present invention as the present invention can be readily disassembled when not in use.

Although the invention has been explained in relation to its preferred embodiment, it is to be understood that many other possible modifications and variations can be made without departing from the spirit and scope of the invention as hereinafter claimed.

What is claimed is:

1. A stretching device comprises:

a first anchor assembly;

a second anchor assembly;

a motion transfer line;

the first anchor assembly comprising a first anchor body and a first motion transfer pulley;

the first anchor body comprising a first strap and a first plurality of anchor points;

the second anchor assembly comprising a second anchor body and a second motion transfer pulley;

the first plurality of anchor points being positioned along the first strap;

the first motion transfer pulley being pivotally coupled to a first anchor point from the first plurality of anchor points;

the motion transfer line being terminally coupled to a second anchor point from the first plurality of anchor points;

the second motion transfer pulley being pivotally coupled to the second anchor body;

the motion transfer line being trained around the first motion transfer pulley and the second motion transfer pulley; and the first plurality of anchor points comprising a plurality of anchor loops formed by a length of material fastened onto the first strap.

2. The stretching device as claimed in claim 1 comprises:

the first anchor assembly further comprising a first detachable pulley-fastener; and the first detachable pulley-fastener being connected in between the first anchor point and the first motion transfer pulley.

3. The stretching device as claimed in claim 1 comprises:

the first anchor assembly further comprising a detachable motion-line fastener; and the detachable motion-line fastener being connected in between the second anchor point and the motion transfer line.

4. The stretching device as claimed in claim 1 comprises:

the motion transfer line comprising a hand connection; and the hand connection being terminally positioned opposite the first anchor body.

5. The stretching device as claimed in claim 1 comprises:

the first anchor body further comprising a first body fastener and a second body fastener;

the first body fastener and the second body fastener being adjacently connected to the first strap;

the first body fastener and the second body fastener being positioned on opposite sides of the first strap; and the first body fastener and the second body fastener being terminally positioned opposite each other along the first strap.

6. The stretching device as claimed in claim 5 comprises:

the first body fastener engaging the second body fastener, wherein the first strap is formed into a loop.

7. The stretching device as claimed in claim 5 comprises:

the first plurality of anchor points being positioned in between the first body fastener and the second body fastener.

8. The stretching device as claimed in claim 1 comprises:

the second anchor assembly further comprising a second detachable pulley-fastener; and the second detachable pulley-fastener being connected in between the second anchor body and the second motion transfer pulley.

9. The stretching device as claimed in claim 1 comprises:

the second anchor body comprising a second strap and a second plurality of anchor points;

the second plurality of anchor points being positioned along the second strap; and the second motion transfer pulley being pivotally coupled to an arbitrary anchor point from the second plurality of anchor points.

10. The stretching device as claimed in claim 9 comprises:

the second anchor body further comprising a first strap fastener and a second strap fastener;

the first strap fastener and the second strap fastener being adjacently connected to the second strap; and the first strap fastener and the second strap fastener being terminally positioned opposite each other along the second strap.

11. The stretching device as claimed in claim 10 comprises:

the first strap fastener engaging the second strap fastener, wherein the second strap is formed into a loop.

12. The stretching device as claimed in claim 10 comprises:

the second plurality of anchor points being positioned in between the first strap fastener and the second strap fastener.

13. The stretching device as claimed in claim 1 comprises:

the second anchor body comprising a second strap and a door anchor;

the second strap being pivotally coupled to the second motion transfer pulley; and the door anchor being terminally connected to the second strap opposite the second motion transfer pulley.

* * * * *